US006475171B1

(12) United States Patent
Williams

(10) Patent No.: US 6,475,171 B1
(45) Date of Patent: Nov. 5, 2002

(54) MASSAGE DEVICE HAVING GROUPS OF PLURAL MASSAGE ELEMENTS INDEPENDENTLY MOVABLE IN RECURRENT MOTION

(76) Inventor: Stella M. Williams, 91 Eastern Road, London (GB), N22 4AS ( * ) Notice: Subject to any disclaimer, the term of this patent is extended or adjusted under 35 U.S.C. 154(b) by 0 days.

(21) Appl. No.: 09/542,597

(22) Filed: Apr. 4, 2000

Related U.S. Application Data

(63) Continuation-in-part of application No. 08/981,438, filed as application No. PCT/GB96/01441 on Jun. 17, 1996, now abandoned.

(30) Foreign Application Priority Data

Jun. 20, 1995 (GB) ..... 9512483

(51) Int. Cl.[7] ..... A61H 15/00; A61H 23/02

(52) U.S. Cl. ..... 601/98; 601/28; 601/100; 601/103; 601/104; 601/111; 601/116; 601/133

(58) Field of Search ..... 601/22, 28–30, 601/51, 56–61, 78, 79, 85–87, 89–95, 97–104, 107, 108, 111, 115, 116, 134, 136, 133

(56) References Cited

U.S. PATENT DOCUMENTS 1,609,796 A 12/1926 Cheney
2,186,105 A * 1/1940 Hall
2,376,000 A * 5/1945 Moshier
3,405,709 A 10/1968 Mathers
5,054,472 A 10/1991 Stefan
5,063,911 A * 11/1991 Teranishi ..... 601/95 X
5,167,225 A * 12/1992 Cheng-I ..... 601/103
5,462,516 A * 10/1995 Anderson

FOREIGN PATENT DOCUMENTS

| | | | | |
|---|---|---|---|---|
| DE | 1902760 | * | 8/1970 | ..... 601/111 |
| EP | 0215519 | | 3/1987 | |
| FR | 1104830 | | 11/1955 | |

* cited by examiner

*Primary Examiner*—Danton D. DeMille
(74) *Attorney, Agent, or Firm*—Bartlett & Sherer; Ronald S. Sherer

(57) ABSTRACT

A massage device for massaging back and/or feet of a user consists of groups of massaging elements connected together so that the elements of each group move together to execute a recurrent motion and press against a resilient surface in contact with the user. The elements in each group are able to move independently of the other groups and the elements are arranged in parallel rows with the massaging elements of each row staggered along the row with respect to the massaging elements of an adjacent row.

13 Claims, 17 Drawing Sheets

MASSAGE DEVICE HAVING GROUPS OF PLURAL MASSAGE ELEMENTS INDEPENDENTLY MOVABLE IN RECURRENT MOTION

This Application is a Continuation-In-Part of Application Ser. No. 08/981,438 filed Dec. 16, 1997 now abandoned, which is a 371 of PCT/GB96/01441, filed Jun. 17, 1996.

This invention relates to a massage apparatus for massaging a part of the human body, such as the back or foot.

Various known massage apparatuses have been proposed which employ vibrating members. Such known apparatuses do not, however, provide a massaging action which compares with a massage given by a human masseur.

It is an object of the present invention to provide a massage apparatus which applies an effective massaging action to a part of the human body which stimulates the action of a human masseur at least to some extent.

SUMMARY

A massage device in which a plurality of massaging elements move toward and away recurrently from the user's body in groups of massaging fingers, and in which the groups of fingers move out of phase with respect to each other so as to move more closely approximate the action of a real massage.

Preferably, each massaging element is resiliently movable in a direction substantially normal to the massaging surface.

In one embodiment of the invention the apparatus is a back massager and the housing comprises means for attaching the apparatus to the body of the user so that the massage surface overlies the user's spine.

In another embodiment of the invention the apparatus is a foot massager and the housing has a base by which the housing is stood on the floor, the housing presenting an inclined wall defining an inclined massage surface for juxtaposition with the sole user's foot.

Preferably, in a foot massager embodying the invention the housing comprises two massaging means at the upper end of the inclined wall of the housing for massaging the toes of a foot juxtaposed with the inclined massage surface.

In order that the invention may be more readily understood, embodiments thereof will now be described, by way of example, with reference to the accompanying drawings, in which.

Figure 15:
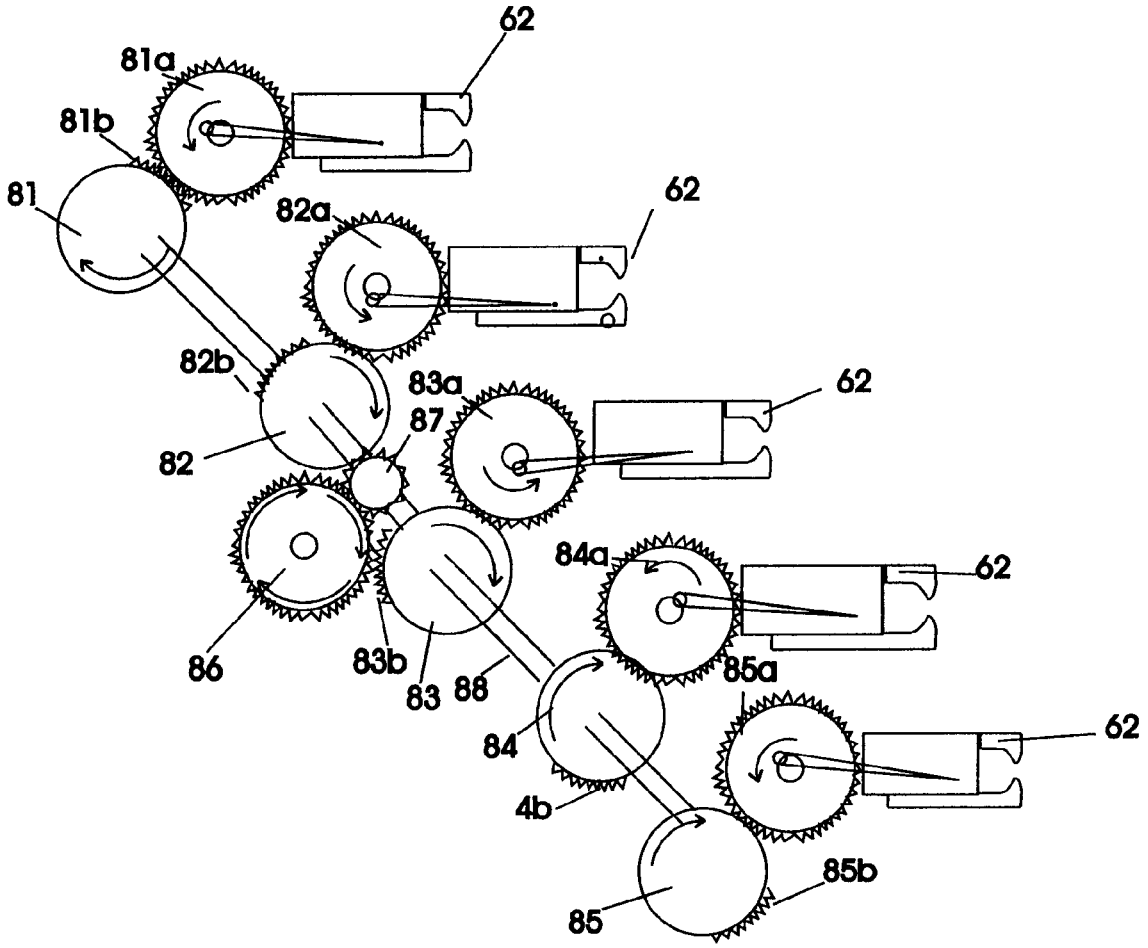
Figure 16:
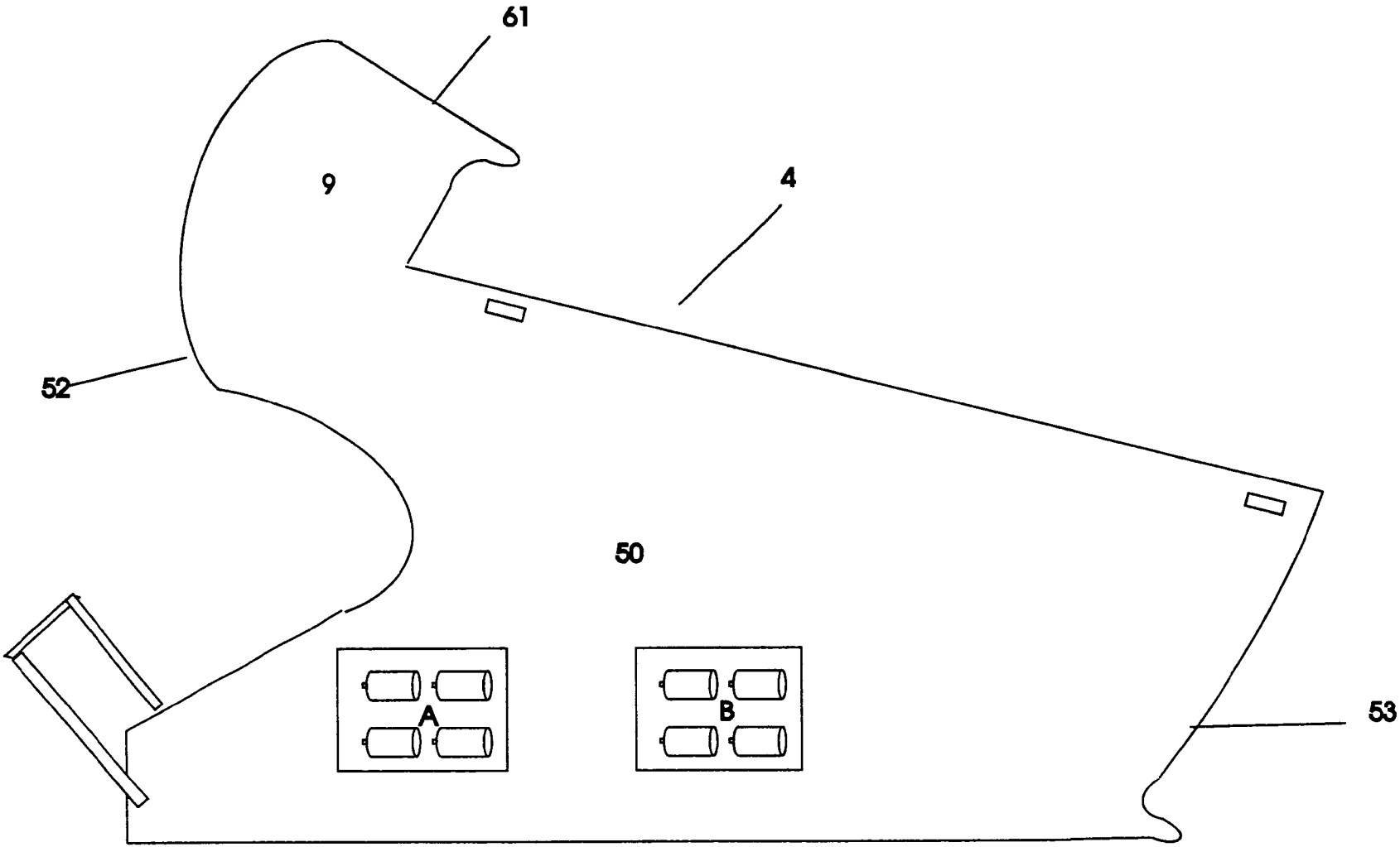

FIG. 15 diagrammatically indicates the movements executed by a set of toe clips corresponding to the toes of the same foot;

FIG. 16 illustrates the use of the housing of the foot massager as a container for electrical batteries required for operation of both the back massager and the foot massager.

Figure 17:
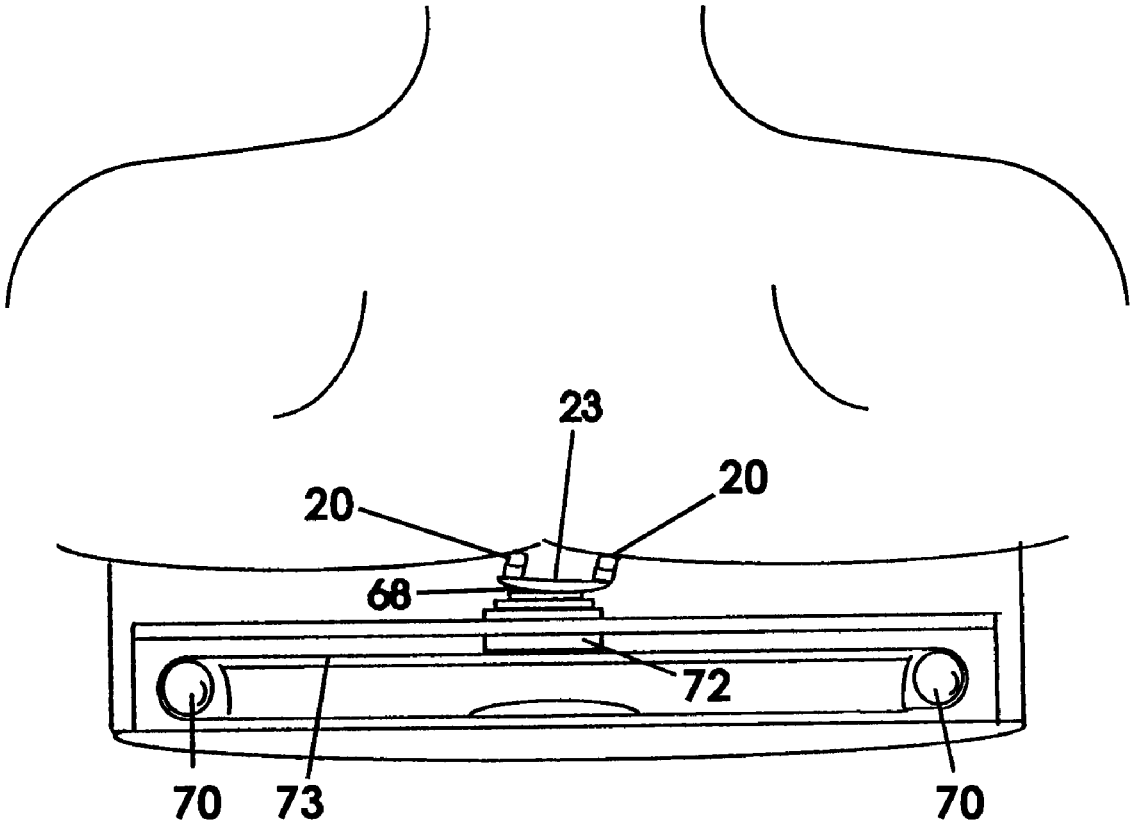

FIG. 17 illustrates a back massager with two fingers

Figure 1:
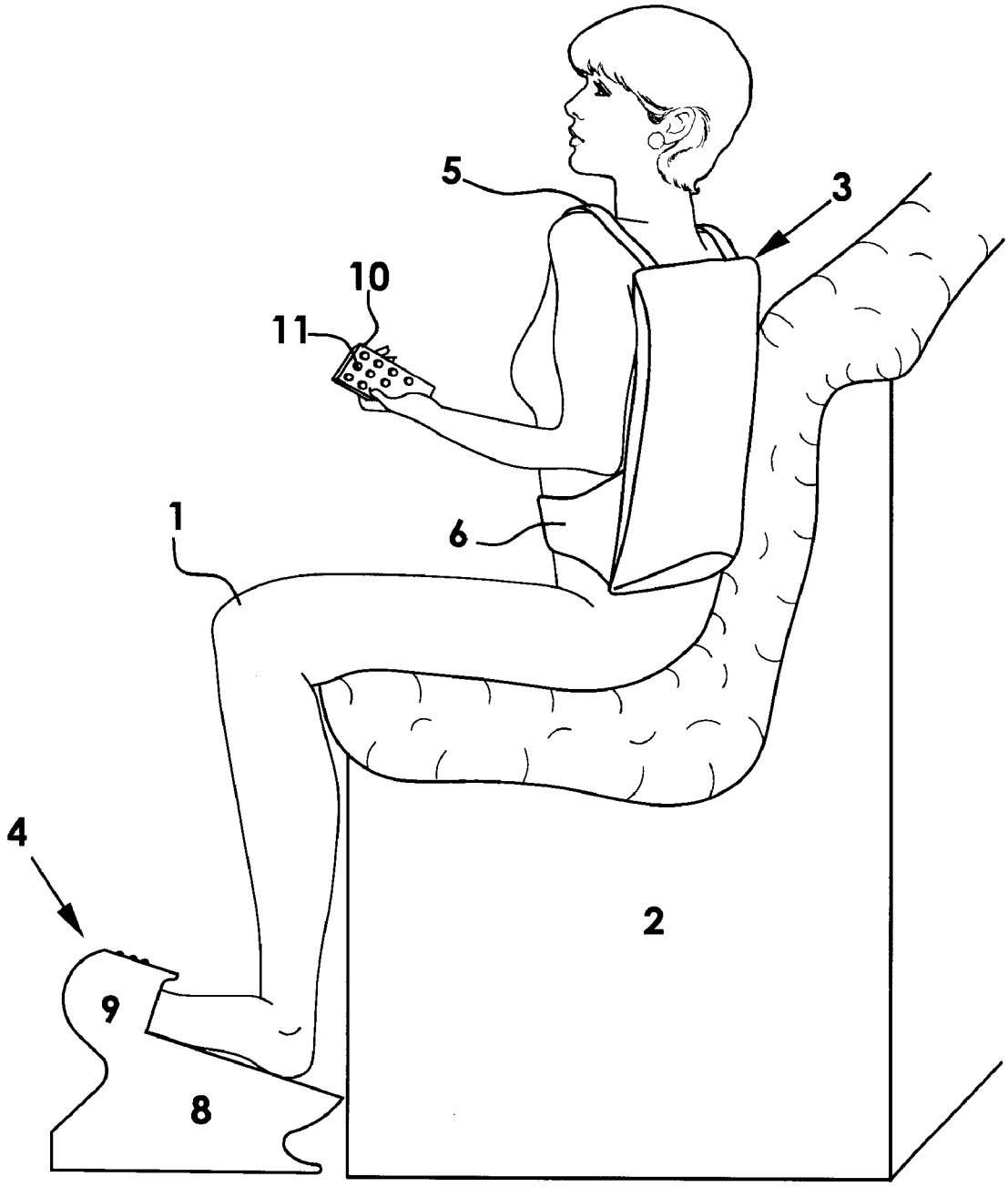
FIG. 1 is a schematic perspective view of a seated person using a back massager forming one embodiment of the invention and a foot massager forming another embodiment of the invention.

Referring firstly to FIG. 1, a person 1 seated in an armchair 2 is shown enjoying a back massage and a foot massage using a back massager 3 embodying the invention and a foot massager 4 embodying the invention.

The back massager 3 is held in contact with the user's back, with a massage surface (not shown in FIG. 1) of the massager juxtaposed with the user's spine, by shoulder straps 5 which embrace the user's shoulders and an elastic midriff belt 6 which encircles the user's trunk.

The foot massager 4 stands on the floor in front of the armchair 2 and the user's feet are placed on an inclined wall 7 of the massager 4 with the sole of each foot juxtaposed with a respective one of two massage surfaces (not shown in FIG. 1) defined in side-by-side relationship, by the inclined wall 7 in a sole massaging part 8 of the massager 4 and with the toes of each foot inserted in a toe massaging part 9 of the massager 4.

Operation of electrically driven movable massaging elements in the back massager 3 and in the sole massaging part 8 of the foot massager 4 may be controlled by a remote controller 10 held by the user 1 and provided with control buttons 11 corresponding to various functions. The controller 10 is operable by the user 1 to transmit a suitable wireless signal to receptors (not shown) on the back and foot massagers 3 and 4 to effect control of the movement of the massaging elements. However, the controller could equally be wired to the massagers 3 and 4 or control could be effected by manual control elements mounted on the massagers 3 and 4 themselves.

Figure 2:
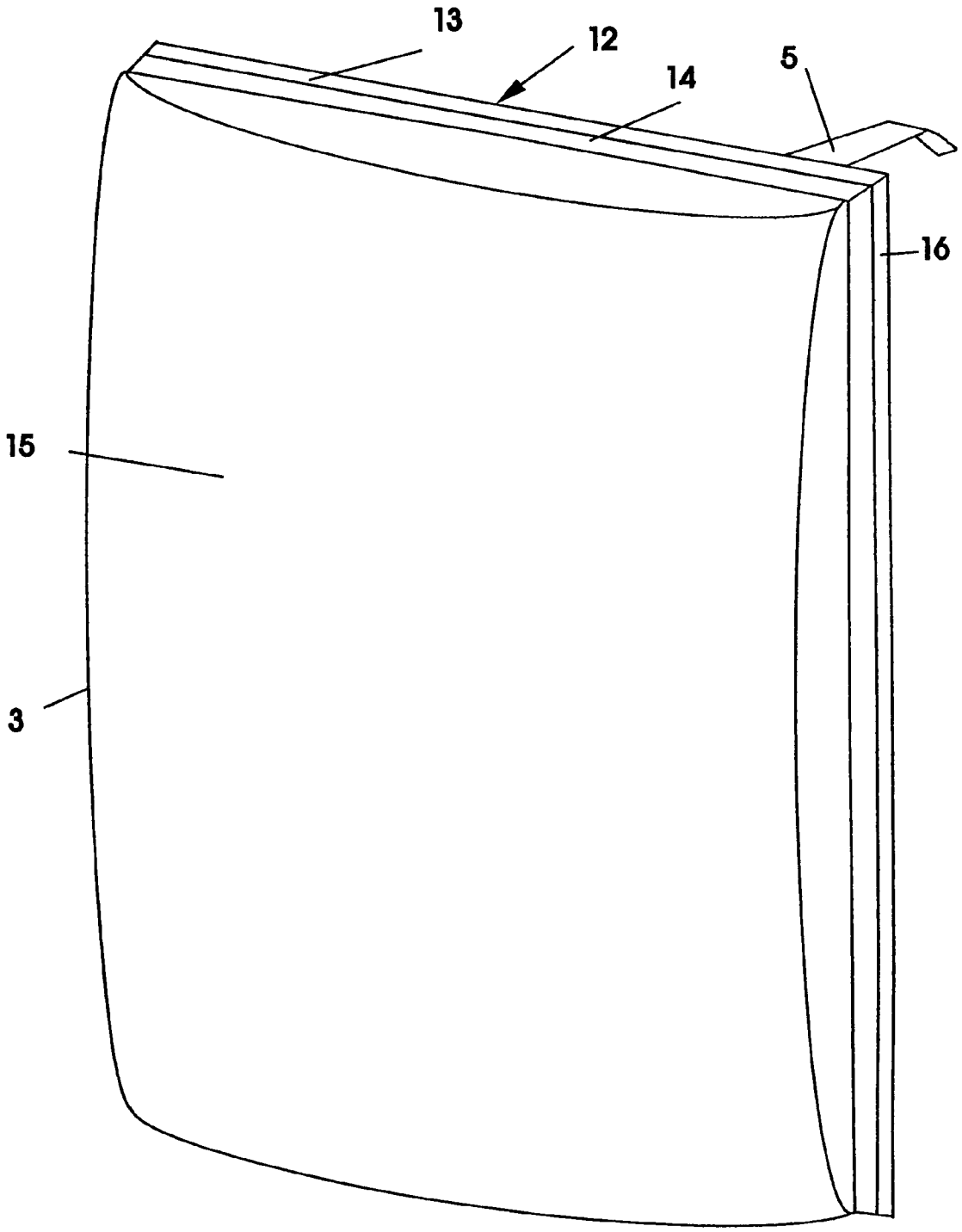
FIG. 2 is a rear perspective view of the back massager shown in FIG. 1.
Figure 3B:
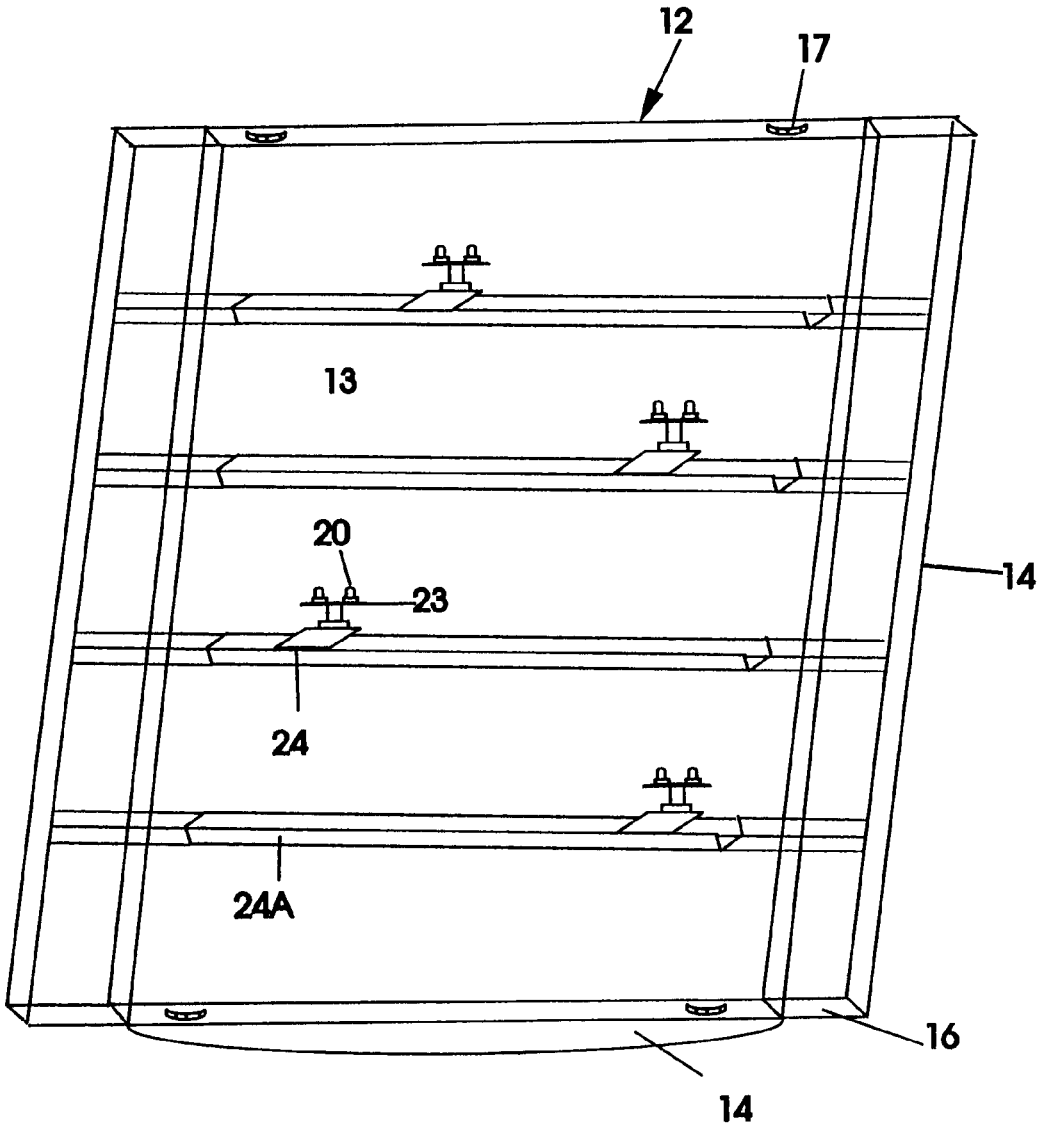
FIG. 3B is a front view of the back massager of FIG. 1 showing the expendable nature of a housing of the massager.
Figure 3A:
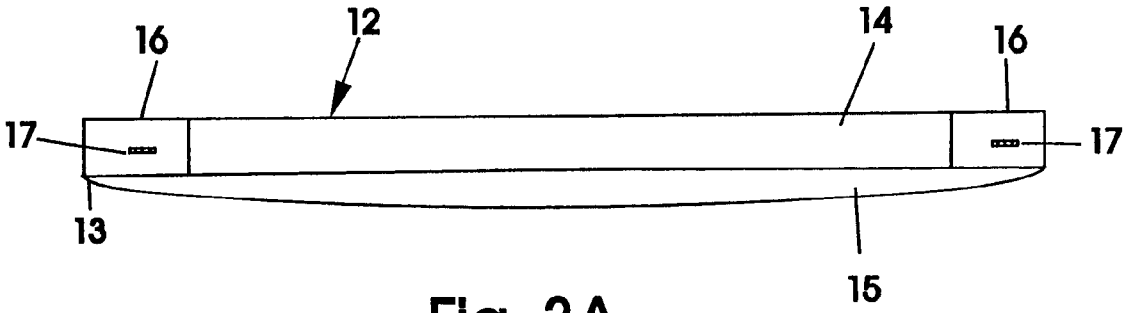
FIG. 3A is an end view of the back massager shown in FIG. 1.

As shown in the rear view of FIG. 2 and the end view of FIG. 3A, the back massager 3 comprises a tray-shaped rectangular housing 12 of plastics material having a base 13 and a peripheral enclosure wall 14 which projects forwardly at right angles to the base 13. A resilient pad 15 is attached to the rear of the housing 12 at the corners thereof so as to cover at least a major portion of the rear of the base 13.

To enable the back massager 3 to be adapted to the width of the back of a person using the massager, provision may be made for moving longitudinal edge sections 16 of the housing 12 towards and away from the longitudinal central axis of the housing 12 to vary the width of the housing 12 as shown in FIG. 3B. This motion is effected by means of adjusting wheels 17.

Figure 4:
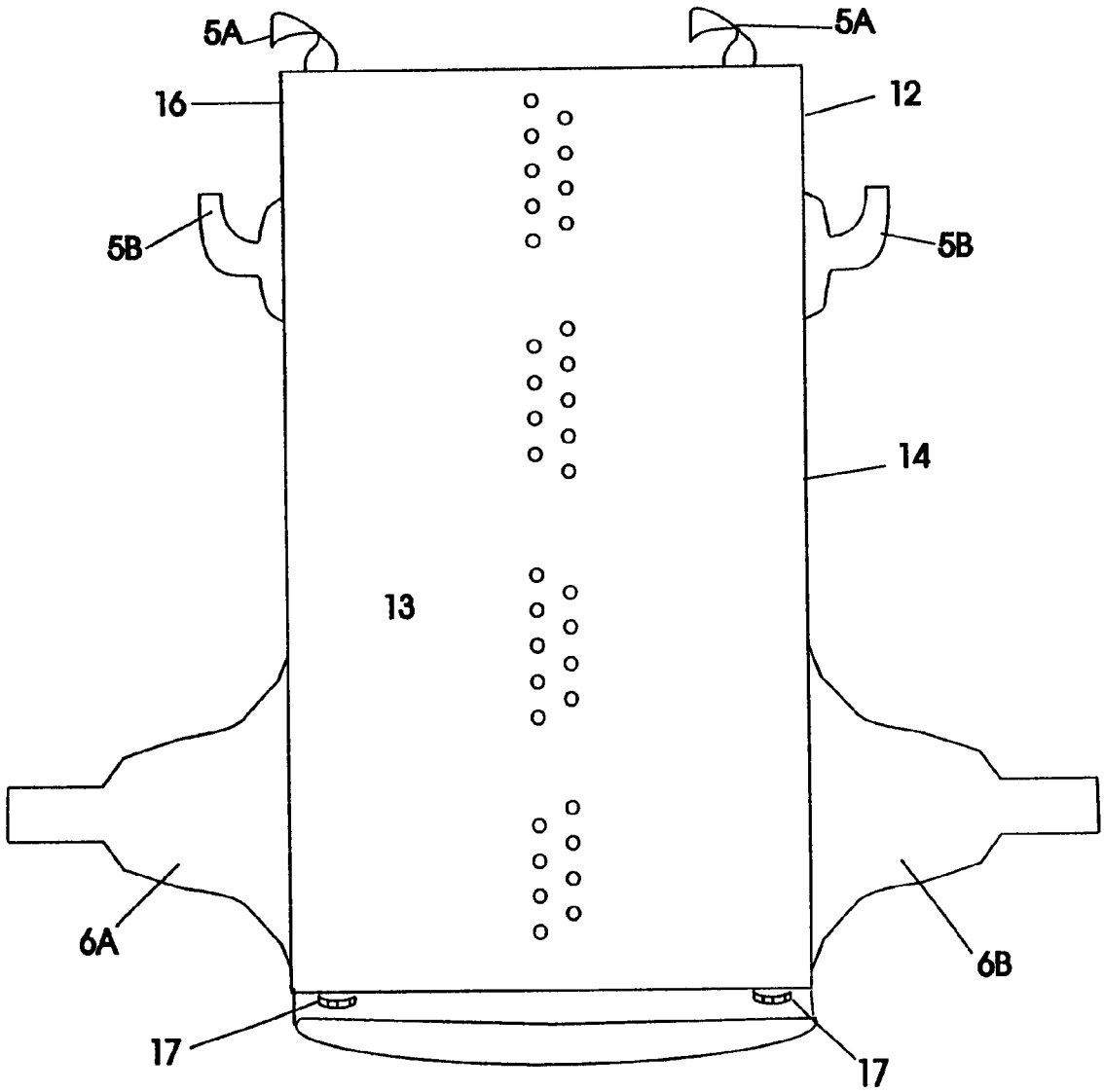
FIG. 4 is a front view of the back massager shown in FIG. 1 with shoulder straps and a midriff belt of the massager shown in the open condition.
Figure 5:
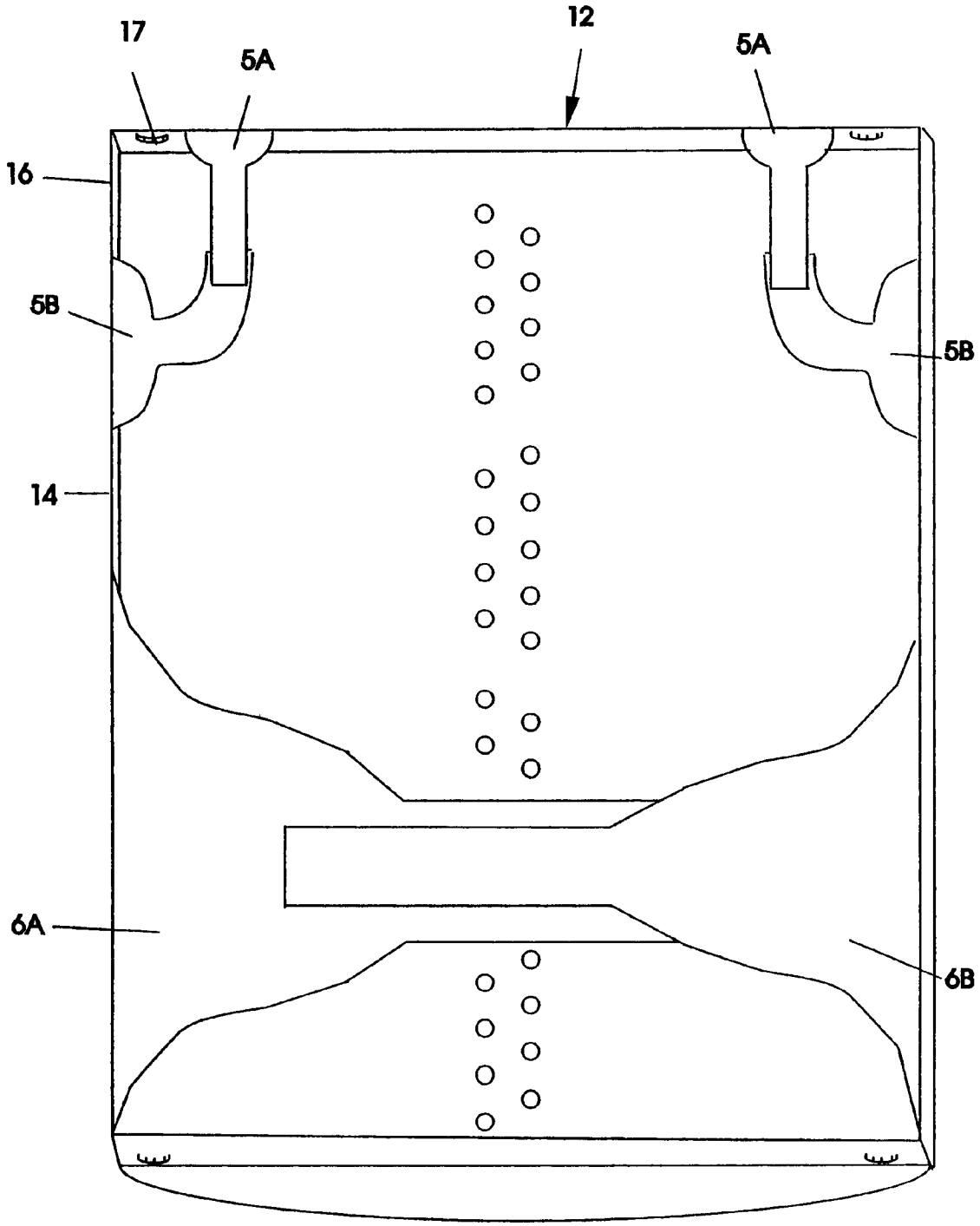
FIG. 5 is a front view of the back massager with the shoulder straps and midriff belt shown in the closed condition.

The housing 12, shoulder straps 5 and the midriff belt 6 are shown in more detail in the front views of FIGS. 4 and 5. Each shoulder strap 5 comprises two portions 5A and 5B attached to respective sides of the housing 12 at an upper corner of the housing and the midriff belt 6 comprises two portions 6A and 6B attached to respective longitudinal sides of the housing near the lower end of the housing. The strap portions 5A and 5B and the belt portions 6A and 6B are provided with cooperating fastening means (not shown), such as buckles or pads of hook and loop material (e.g. that known by the RTM 'Velcro'), to secure the cooperating strap and belt portions together in position around the body of the user.

Figure 6:
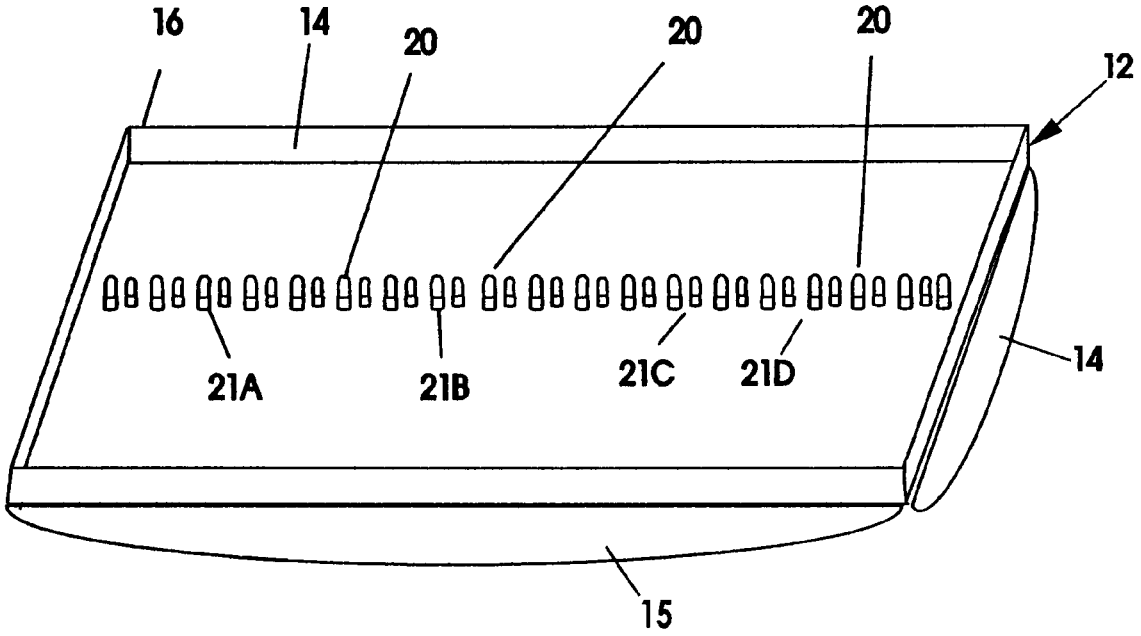
FIG. 6 is a schematic front perspective view of the back massager showing the arrangement and grouping of housing of the back movable massaging elements in a massager.

As illustrated schematically in FIGS. 4 and 5, movable massaging elements 20 are mounted in the housing 12 on the base 13. The massaging elements 20 are resiliently movable by means to be described later in a direction which is substantially normal to the elongate rectangular massage surface defined by the opening enclosed by the rim of the peripheral enclosure wall 14, so that the massaging elements 20 engage the back of the user through the massage surface during use of the massager 3. As indicated, the massaging elements 20 are arranged, in a mean position of the elements shown in FIGS. 4 and 5, in two rows extending parallel to the central longitudinal axis of the massage surface and on respective sides of the longitudinal axis. The massaging elements 20 in each row are staggered along the row with respect to the massaging elements of the other row, so that each element 20 is located centrally between two adjacent elements 20 of the other row. The massaging elements 20 are driven to execute a recurrent motion which is a linear motion of limited amplitude at right angles to the length of the row of elements and is centered on the mean position of the elements shown in FIGS. 4 and Referring to FIGS. 6 and 7, the massaging elements 20 are divided into four groups 21A–D, each containing elements from both rows and each of the groups 21A–C comprising nine massaging elements 20 while the group 21D, which is lowermost in use, comprising eight elements 20. The group 21A, which is uppermost in use, is divided into two sub-groups 21E and 21F.

The groups 21A–21D of massaging elements 20 are aligned along the rows in the mean position of the elements but may be moved independently with the above-mentioned recurrent motion at right angles to the rows on both sides of the central longitudinal axis of the massage surface. As indicated by the arrows in FIG. 6, adjacent ones of the groups 21A to 21D are moved in antiphase in opposite directions during use of the massager, the sub-groups 21E and 21F however being moved together as the single group 21A. The groups 21A to 21D may be moved recurrently in pairs with groups 21A and 21B moving in opposite directions with groups 21C and 21D stationary, then groups 21B and 21C moving with groups 21A and 21D stationary and then groups 21C and 21D moving with groups 21A and 21B stationary. Alternatively, all groups may be moved at the same time.

Two different amplitudes of the recurrent-movement of the massaging elements about the longitudinal axis of the massage surface may be selected to effect massaging of a narrow area of the user's back around the spine or to effect a more wide ranging massage across the whole back.

Figure 7A:
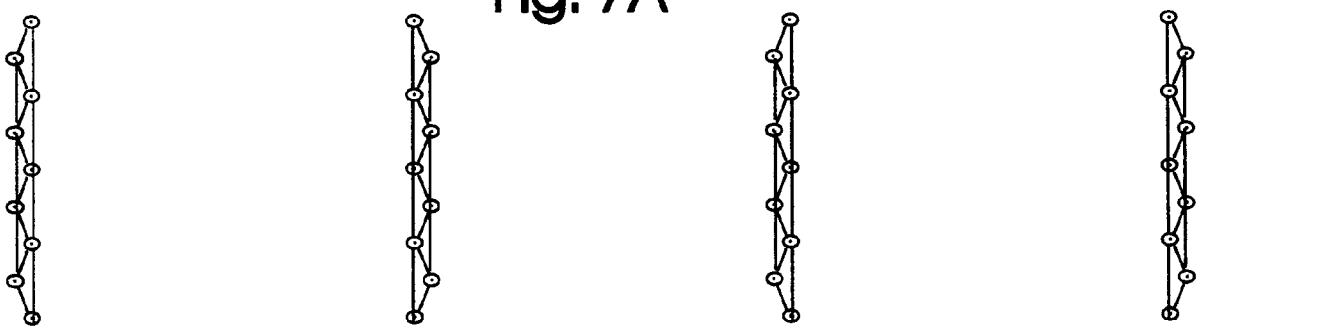
FIGS. 7, 7A and 7B are diagrammatic illustrations of the mechanical arrangement of the movable massaging elements of the back massager and the movements performed by these massaging elements.
Figure 7:
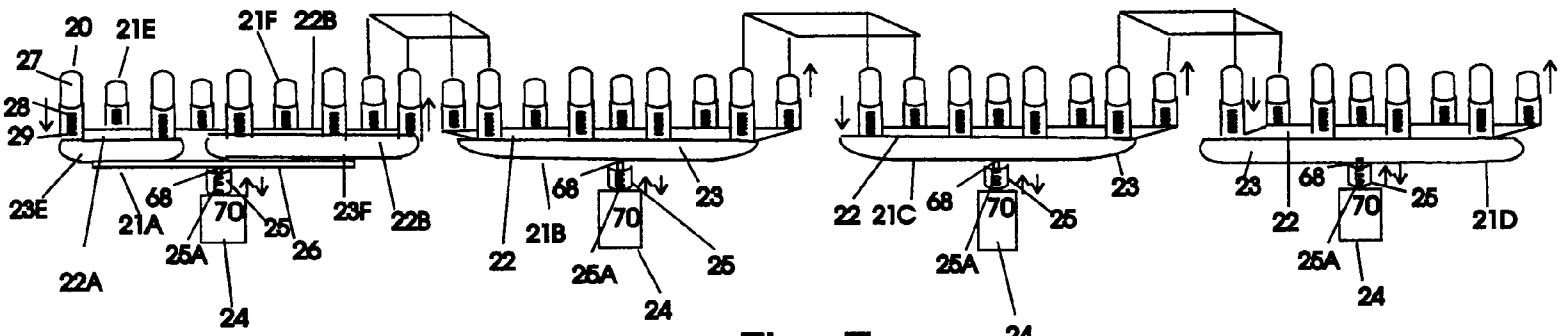
Figure 7B:
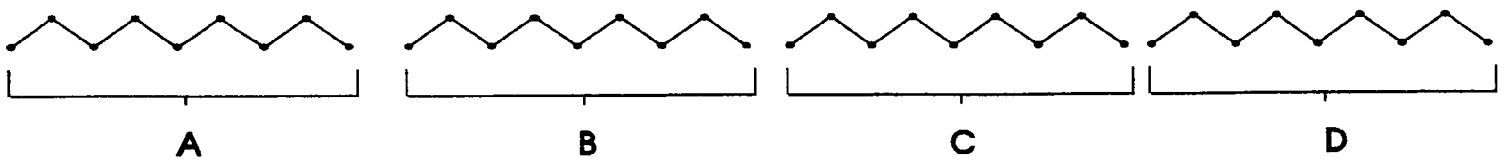

FIG. 7 illustrates in more detail the mechanical construction and arrangement of the movable massaging elements 20 and FIGS. 7A and 7B show a schematic view from above and the side respectively. Each of the groups 21A to 21D of elements 20 is mounted on a platform 22 on a carrier 23 which in turn is mounted on a carriage 24 electrically driven by drive means 70 and which is movable along a track 24A (see FIG. 3B) fixed to the base 13 of the housing so as to impart the required recurrent motion to the massaging elements 20. The carriers 23 are independently movable and the platforms 22 are mounted on the carriers 23. The carriers 23 are mounted on the respective carriages 24 by expandable means 25 including springs 25A for resiliently displacing the carriers 23 towards the massage surface, so as to allow the groups of massaging elements 20 to follow the contours of the user's back and exert a selected pressure on user's back and pivotal means 68 so that the carriers 23 are capable of limited pivoting movement about the direction normal to the massage surface so as to enable the groups of massaging elements 20 to adapt to the shape of the user's back The group 21A of elements 20 which is uppermost in use is divided into two subgroups 21E and 21F as described above and each of these sub-groups is mounted on a respective sub-platform 22A, 22B in turn mounted on a respective sub-carrier 23E, 23F. Both sub-carriers 23E and 23F are, however, mounted on the same carriage 24 by means of a link 26. This shown in the embodiment of FIG. 17 in which two fingers 69 of the same construction as fingers 27 in FIG. 7 are mounted on carrier 23 which is pivotally mounted on carriage 24 by means of pivotal means 68. In order to move the location of the fingers 69 across the back the carriage is mounted on a toothed belt 74 which can rotate about toothed wheels 76 and 78 and, in operation, by moving the carriage 24 by means of toothed belt 74 different parts of the back can be massaged.

Each of the movable massaging elements 20 comprises a cylindrical finger 27 having a rounded, e.g. part spherical, free end. The fingers 27 are made of a resilient material, such as rubber, and are captively but slidably received in respective cylindrical holders 28 made of rigid material so that the free end of the finger 27 projects from an open end of the holder 28. A spring 29 is disposed in the holder 28 between a closed end of the holder and the inner end of the finger 27 to resiliently bias the finger 27 into its position projecting from the open end of the holder 28.

During the recurrent movement of the elements 20, the carriers 23 and thus the elements 20 on their platforms 22 are resiliently biased in a direction which is substantially normal to the plane of the massage surface by the expandable means 25 to exert a desired pressure on the user's back. Accordingly, during use of the apparatus, the elements 20 resiliently engage and push the superficial layers of the user's back as they execute the recurrent motion.

Figure 8:
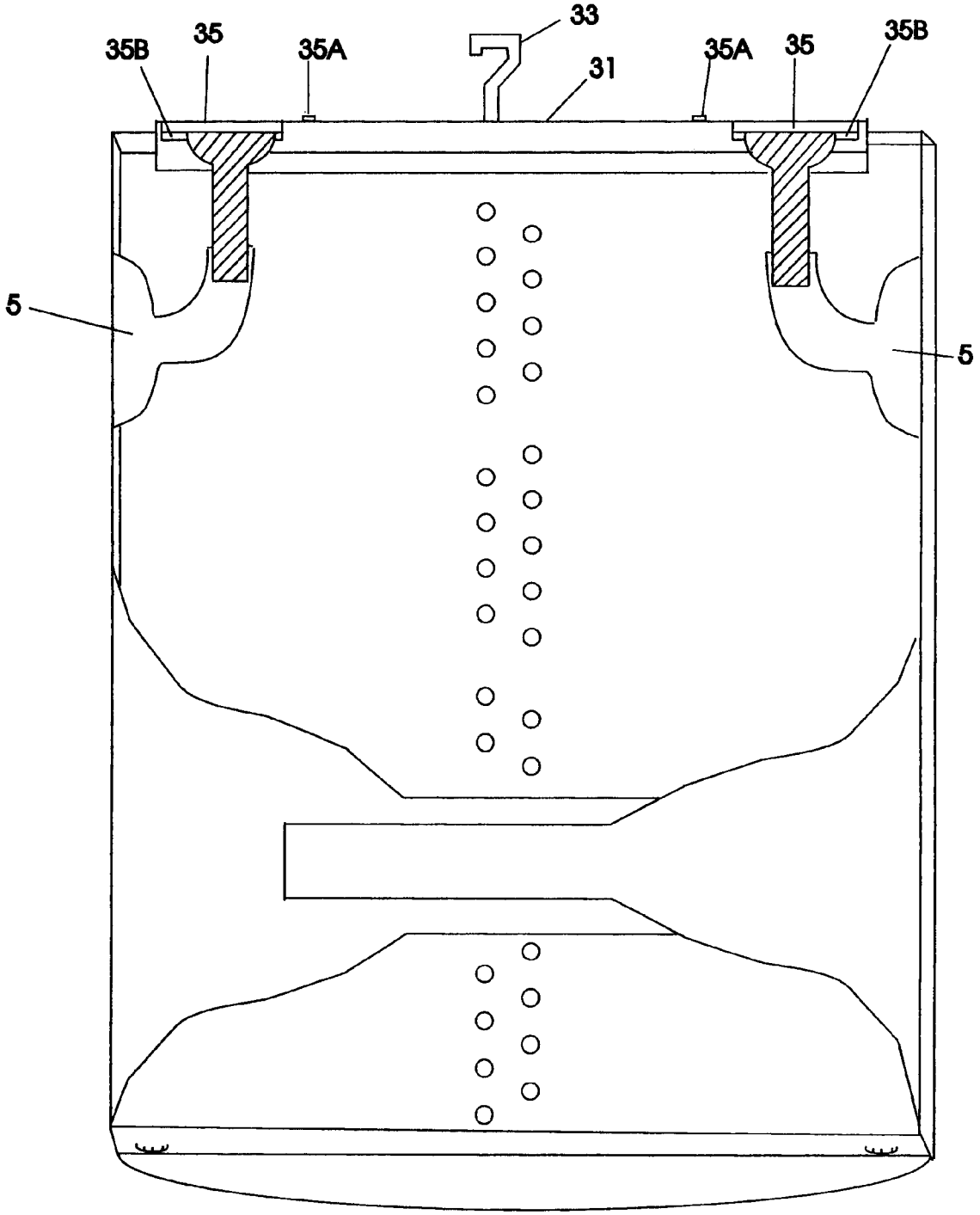
FIG. 8 shows, in front view, a hanger for the back massager in a storage cover for supporting protecting the back massager when not in use.
Figure 9:
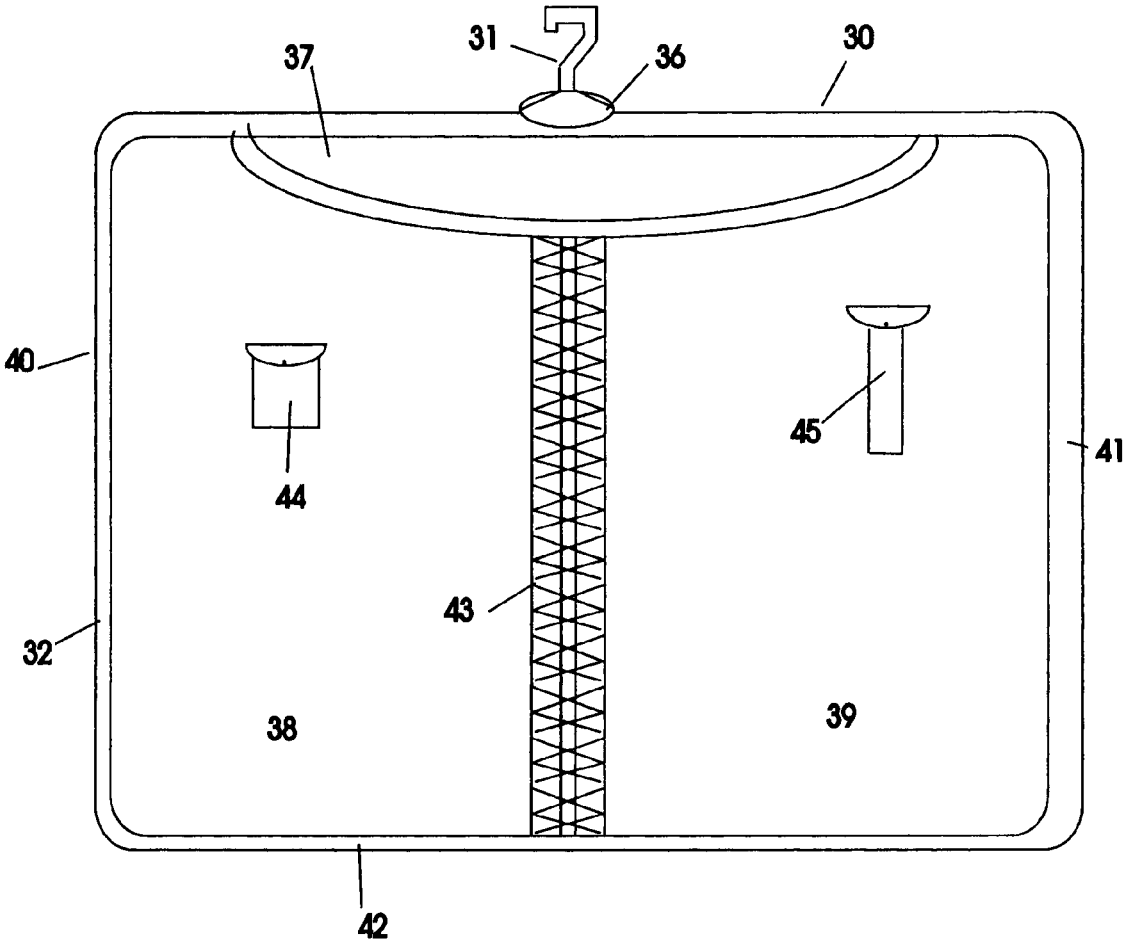
FIG. 9 shows, in front view, the hanger and supported back massager of FIG. 8 enclosed within the storage cover.
Figure 10:
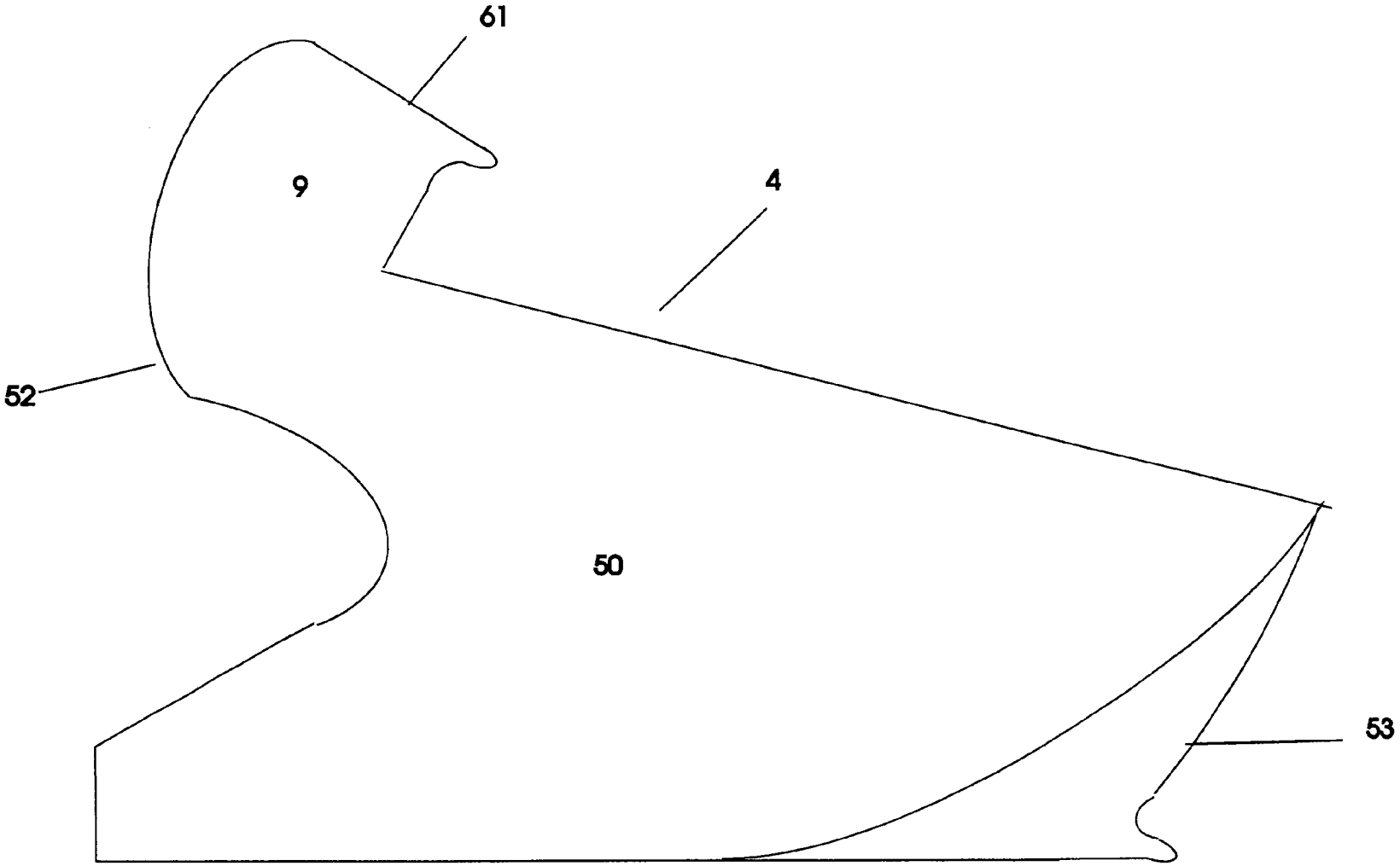
FIG. 10 is a side view of the foot massager embodying the present invention shown in FIG. 1.
Figure 11:
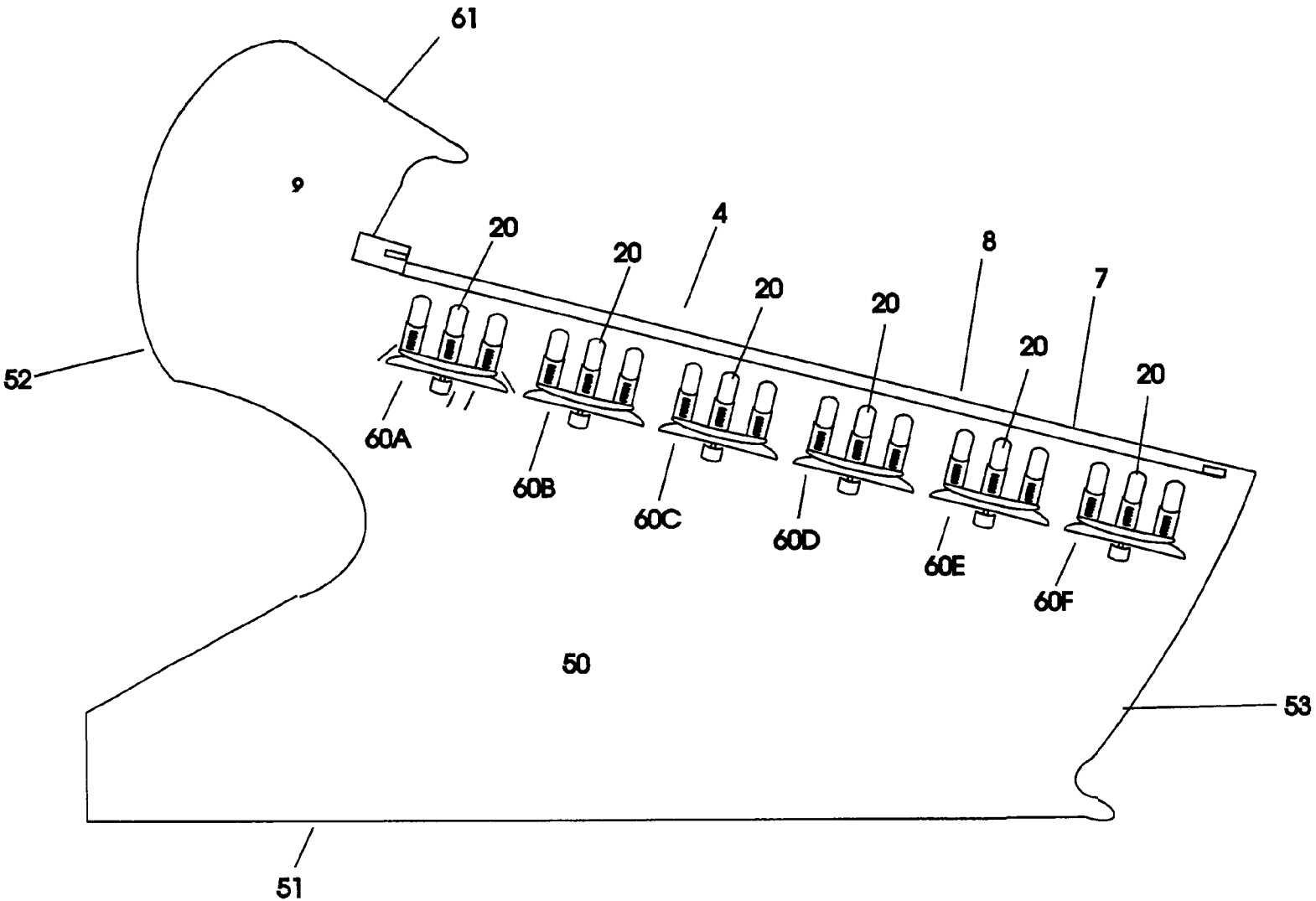
FIG. 11 is a sectional view diagrammatically showing the arrangement and grouping of movable sole massaging elements in a housing of the foot massager.

When not in use, the back massager 3 may be stored in a hanging cover 30 which, as illustrated in FIGS. 8 and 9, comprises a hanger 31 and a cover 32. As shown in FIG. 8, the hanger 31 comprises a hook 33 and a bar 34 with slidable end pieces 35 resiliently biased into an outwardly extended position. The end pieces 35 are each retractable against the resilient bias by pushing a respective projection 35A on the end piece towards the hook to allow a respective shoulder strap 5 of the back massager 3 to be introduced into the gap 35B between the end piece 35 and the bar 34 as shown in FIG. 8. The projection 35A is then released to trap the shoulder strap within the gap beneath the end piece 35.

The hanger 31 with the back massager 3 supported thereon is received in the cover 32 with the hook 33 extending through an opening 36 of the cover as shown in FIG. 9. The cover 32 comprises a rear wall 37 and two side flaps 38 and 39 connected to the rear wall 37 along side edges 40, 41 and the bottom edge 42 thereof.

The flaps 38 and 39 are connected together by a zip fastener 43 which may be undone to allow the hanger 31 and the suspended back massager 3 to be inserted into the cover and then done up to enclose the hanger 31 and massager 3 in the cover 32. The flaps 38 and 39 may be provided with external pockets 44 and 45 for containing accessories, such as brush for applying massage oil to the part of the body to be massaged before donning the massager 3 in order to enhance the effect of the massage.

Referring now to FIGS. 10 to 16, the foot massager 4 comprises a housing 50 of plastics material having a base wall 51, front and rear walls 52 and 53 and the inclined top wall 7 which inclines upwardly from the rear wall 53 to define the sole massaging part 8 of the massager 4. The toe massaging part 9 of the massager 4 is formed at the top of the inclined wall 7 adjacent the front wall 52.

Figure 12:
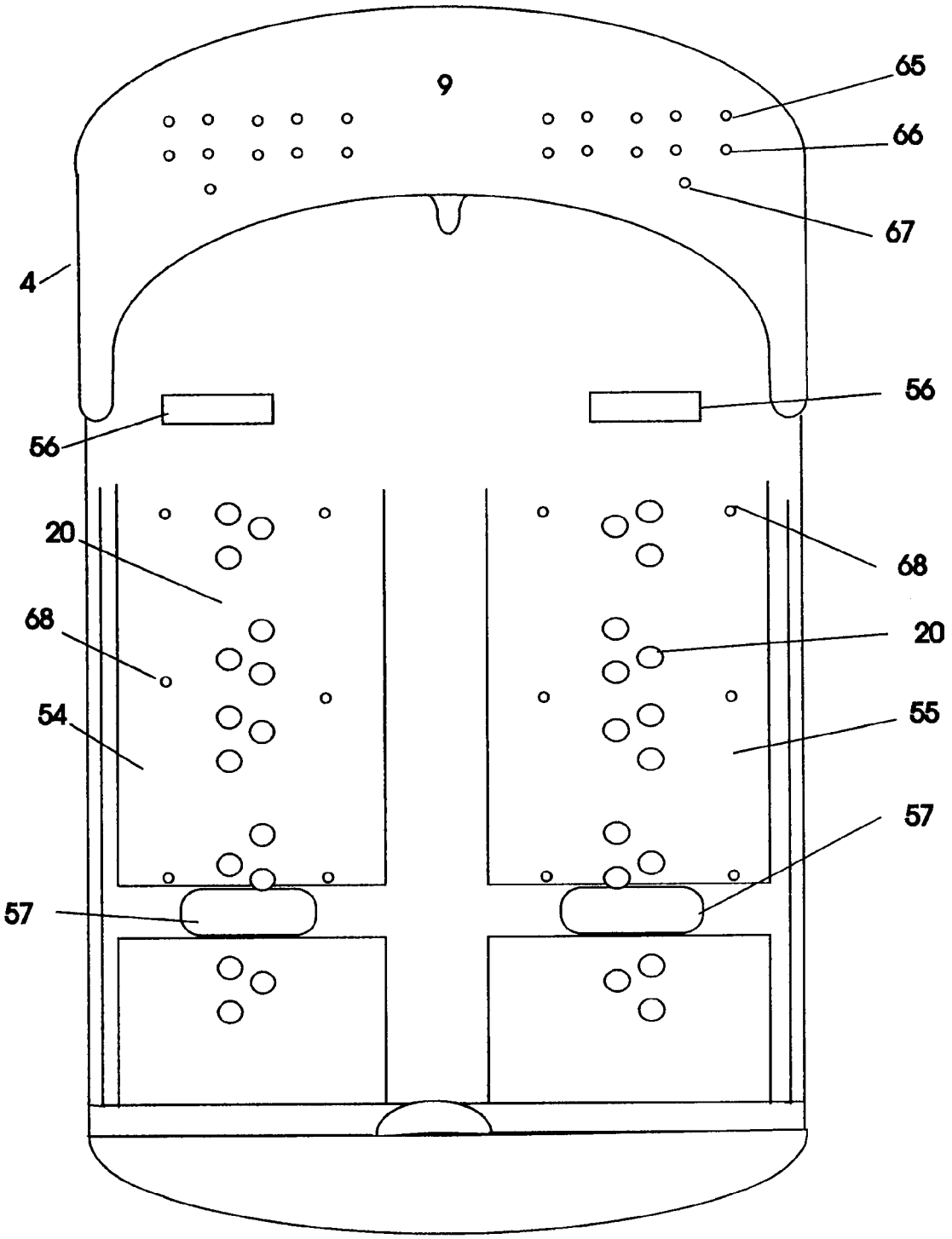
FIG. 12 is a top view of the foot massager diagrammatically showing the massaging elements.

As shown in FIG. 12, the inclined top wall 7 has a pair of side-by-side elongate rectangular openings 54,55 each of which defines a respective massage surface for juxtaposition with the sole of a respective foot of a user. A first rest 56 is provided at the top of each opening 54,55 to support the ball of the foot placed on the inclined wall 7 and a second rest 57 is provided near the bottom of each opening 54,55 to support the heel of a foot. The rests 56 and/or rests 57 may be movably mounted so that they can be adjusted to suit the length of the foot of a particular user.

Movable massaging elements 20 having the same construction as the massaging elements of the back massager 3 are mounted beneath each of the openings 54,55 in the inclined wall 7, so as to engage the sole of a foot juxtaposed with the opening 54,55.

The elements 20 are mounted beneath each opening 54,55 on an inclined support surface located within the housing 50 and parallel to the inclined wall 7. In the mean position of the elements 20 illustrated in FIG. 12, the elements 20 extend in two rows parallel to the central longitudinal axis of the respective opening 54,55 on respective sides of the longitudinal axis. As in the case of the back massager, the elements 20 are divided into groups and in the present case the elements 20 associated with each opening 54,55 are divided into six groups 60A-F each consisting of three massaging elements. In use, successively adjacent pairs of groups, e.g. 60A and 60B and then 60B and 60C, may be moved in opposite directions recurrently while the remaining groups remain stationary. Alternatively, all groups may be moved at the same time. The recurrent movement of the massaging elements 20 has a predetermined amplitude determined by the setting of buttons 68.

The toe massaging part 9 of the foot massager 4 comprises a hood 61 to receive the toes of the user's feet placed on the sole massaging part 8 of the massager 4. The hood 61 houses two sets of five toe clips 62 for gripping and pulling the toes of the feet. Each toe clip 62 has an upper jaw 63 which is movable relative to a lower jaw 64 of the toe clip to grip a toe placed between the upper and lower jaws 63 and 64 in a separated condition of the jaws. The jaws 63 and 64 are made of or are coated with a resilient material at least where they contact the toe of a user.

Each set of toe clips 62 is electrically drivable in the closed position gripping a toe to pull the toe longitudinally of its length. The clips 62 of a set are moved sequentially in an overlapping relationship so that a wavelike action is exerted on the toes of the foot. Control buttons 65 disposed on the hood 61 enable the upper jaws 63 of the toe clips 62 to be individually raised manually to enable a toe to be inserted into the clip. Buttons 66 enable the clips 62 to be moved manually forwards and backwards individually within the hood 61. Buttons 67 enable each of the sets of five toe clips to be moved manually as a unit to the left and the right.

Figure 12A:
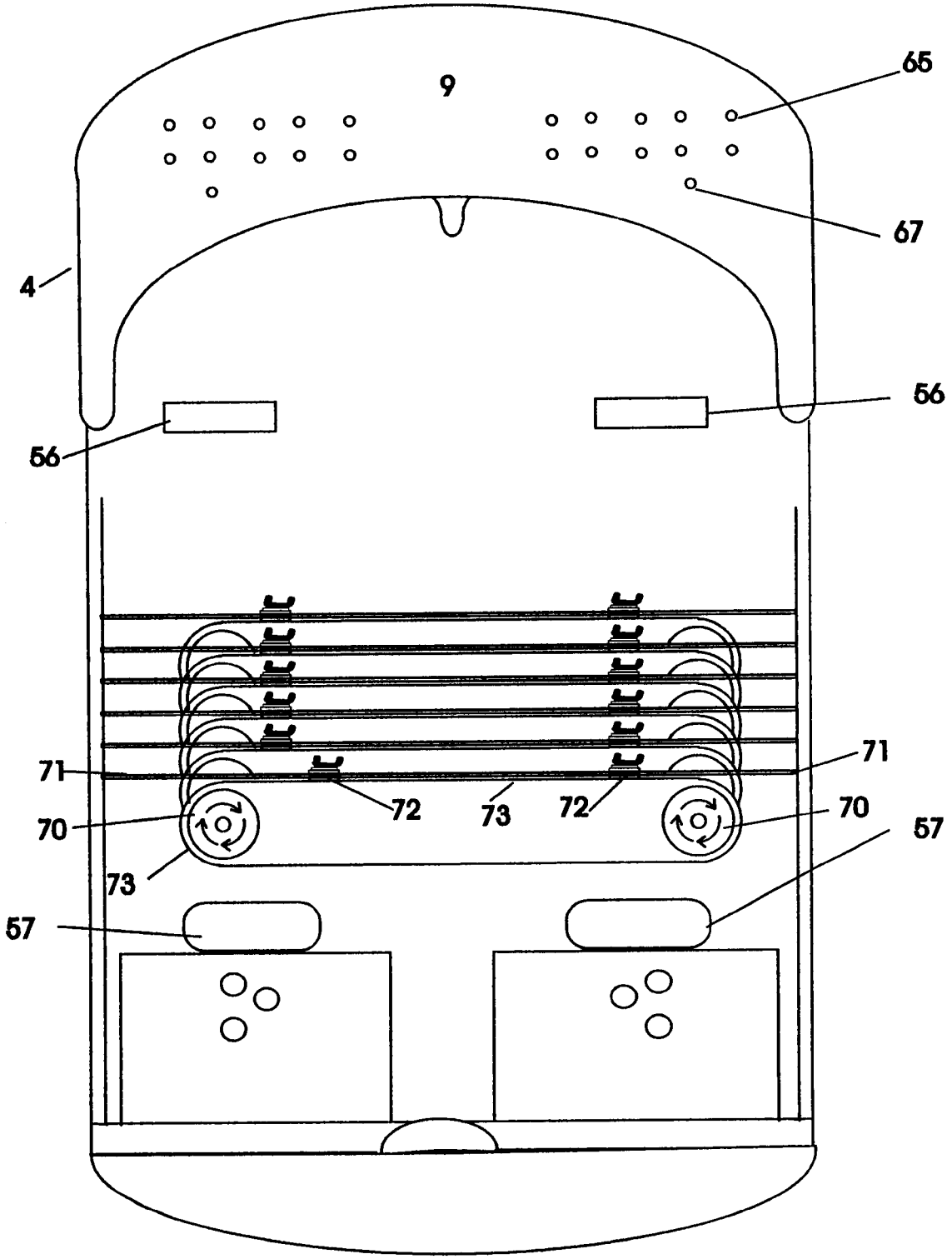
FIG. 12A is another view of the foot massager diagrammatically showing the massaging elements.
Figure 13:
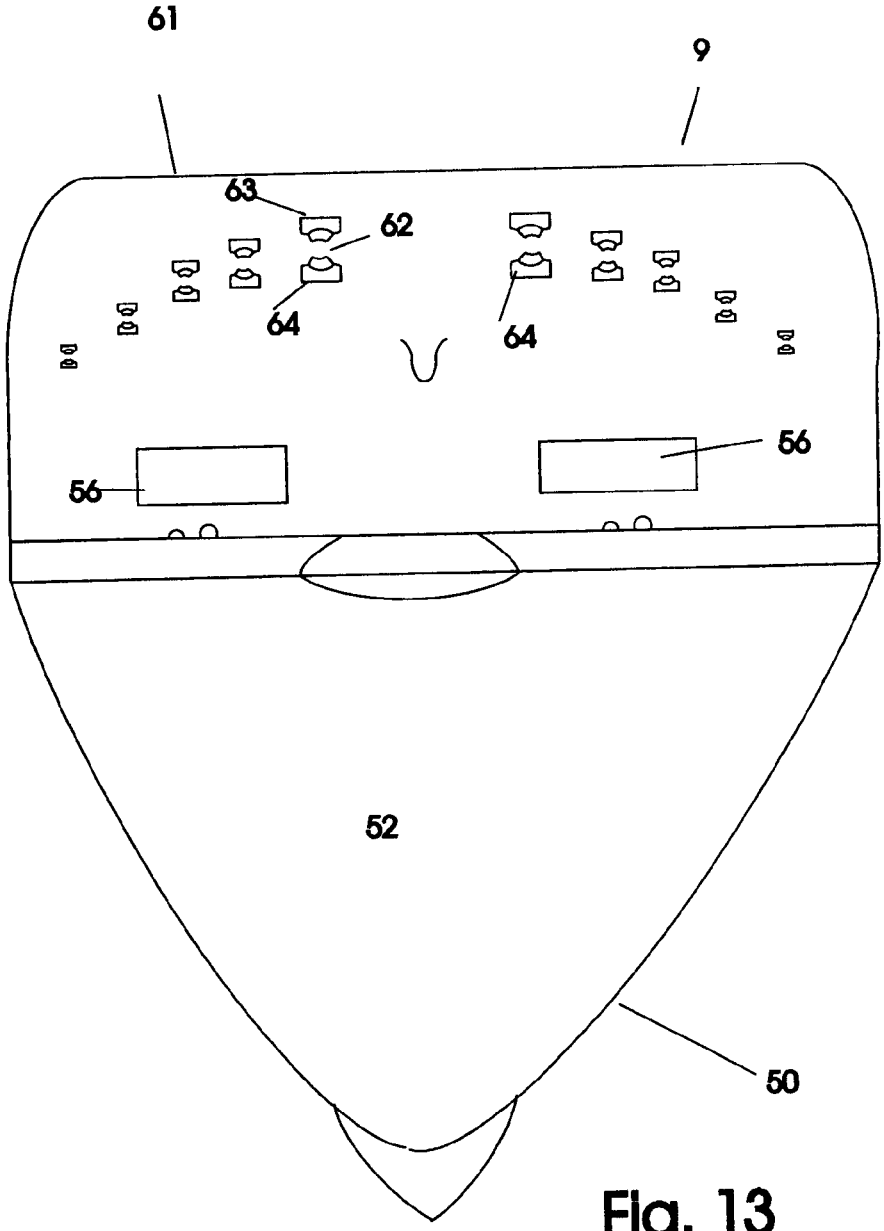
FIG. 13 is a view from a lower end of the foot massager showing the interior of a hood of a toe massaging part of the foot massager.
Figure 14:
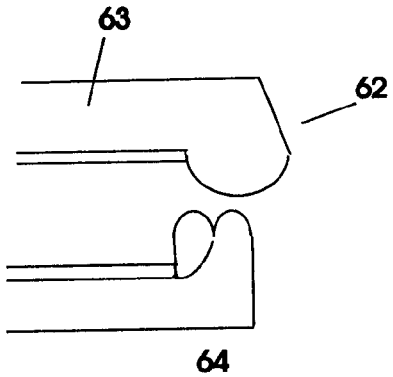
FIG. 14 illustrates the construction of an individual toe clip of the toe massaging part of the foot massager.

Referring to FIG. 12*a* the fingers 72 are mounted on bar 71 so that it can move along the bar. The toothed wheel 70 has toothed belt 73 engaging with it so that movement of the wheels 70 cause the toothed belt to move and so the fingers 72 can move along the bar. Referring to FIG. 15 the toothed wheel 86 drives axle 88 via toothed wheel 87, mounted on axle 88 are wheels 81, 82, 83, 84 and 85 which have a toothed section 81*b*, 82*b*, 83*b*, 84*b* and 85*b* respectively which extend over part of the circumference of the wheel. These toothed sections engage with toothed wheels 81*a*, 82*a*, 83*a*, 84*a* and 85*a*. In use the wheel 86 rotates and so causes the axle 88 to rotate and which causes the toe clops 62 to operate.

As illustrated in FIG. 16, the housing 50 of the foot massager 4 may be used to accommodate the electrical batteries required for operation of both the sole massaging part of the foot massager and the back massager 3.

FIG. 17 illustrates the application of the present invention to the back of the user, and the reference numerals represent the same elements as previously described.

What is claimed is:

1. A massaging apparatus for massaging a part of the human body comprising:

(a) a housing;

(b) a resilient layer having a length and forming a massaging surface connected to said housing (c) massaging means mounted in said housing for moving portions of said resilient layer toward and away recurrently from the part of the body to be massaged (d) said massaging means comprising a plurality of separate groups of massaging elements, each of said groups of massaging elements comprising a plurality of massaging elements and carrier means for connecting said massaging elements together to move in unison as a group (e) drive means for separately moving each of said carrier means and (f) pivotal means connecting said carrier means to said drive means for moving each of said massaging elements toward and away from said resilient layer for massaging the body part through said resilient layer.

2. The massage apparatus of claim 1 in which said drive means includes means for moving said groups of massage elements in one direction toward said resilient layer and for moving an adjacent group of massage elements in the opposite direction for producing an out of phase massaging action along the length of the said resilient surface and the body part engaged thereby.

3. The massage apparatus of claim 1 wherein massage elements are positioned in at least two rows, said rows extending parallel to the length of said resilient surface.

4. The massage apparatus of claim 3 wherein said massage elements in one row are staggered in the direction of said length relative to the massage elements in the other row.

5. The massage apparatus of claim 3 wherein each of said groups of massage elements includes massage elements from more than one of said rows.

6. The massage apparatus of claim 1 wherein the body part is the back of a user, and said massage apparatus is of a size and shape such as to conform to the shape of the back of the user.

7. The massage apparatus of claim 6 wherein said massage apparatus is of a size and shape such as to be portable and including strap means for attaching said massage apparatus in engagement with the back of the user.

8. The massage apparatus of claim 1 including cover means for enclosing said apparatus, and resiliently biased locking means for securing said cover means in an enclosed position surrounding said massage apparatus for being carried by the user.

9. The massage apparatus of claim 1 wherein said housing and said resilient layer are of an elongated rectangular shape for conforming with the back of a user.

10. The massage apparatus of claim 1 wherein said massage apparatus is of a size and shape such as to conform to the soles of the feet of the user.

11. A massage apparatus of a size and shape to receive and massage the feet of the user comprising:

(a) a housing;

(b) said housing having a flexible layer extending in a first direction;

(c) first and second rows of resilient elements supported in said housing, said first and second rows of resilient elements being positioned such as to be adjacent the first and second feet of the user and being positioned on the side of said flexible layer opposite the feet of the user;

(d) said resilient elements in each of said rows being arranged in separate groups of resilient elements;

(e) actuating means for individually actuating each of said groups of resilient elements into engagement with said resilient layer and through said layer to the user's feet, said massaging means being mounted in said housing for moving portions of said resilient layer toward and away recurrently from the part of the body to be massaged; and (f) a second set of massage elements comprising pairs of toe clamps of a size and shape for clamping the toes of the user.

12. The massage apparatus of claim 11 further including actuator means for moving said toe clamps in directions parallel to the length of the user's toes.

13. The massage apparatus of claim 12 wherein said toe clamps are arranged in separate groups, and said actuator means include means for independently actuating said separate groups toe clamps.

* * * * *